US007645082B2

(12) United States Patent
Kawaguchi

(10) Patent No.: US 7,645,082 B2
(45) Date of Patent: Jan. 12, 2010

(54) DOT HEAD AND METHOD OF MANUFACTURING ARMATURE STRUCTURE FOR DOT HEAD

(75) Inventor: Takahiro Kawaguchi, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 541 days.

(21) Appl. No.: 11/369,154

(22) Filed: Mar. 6, 2006

(65) Prior Publication Data

US 2007/0065211 A1 Mar. 22, 2007

(30) Foreign Application Priority Data

Sep. 22, 2005 (JP) ..... 2005-276588

(51) Int. Cl.
*B41J 2/275* (2006.01)

(52) U.S. Cl. ..... 400/124.23; 400/124.11

(58) Field of Classification Search ..... 400/124.23, 400/124.11

See application file for complete search history.

(56) References Cited

U.S. PATENT DOCUMENTS

| | | | | |
|---|---|---|---|---|
| 2,419,862 | A | 4/1947 | Wales | |
| 5,205,659 | A | 4/1993 | Gugel et al. | |
| 5,290,112 | A | 3/1994 | Stempfle et al. | |
| 5,556,211 | A * | 9/1996 | Kwon | 400/124.11 |

(Continued)

FOREIGN PATENT DOCUMENTS

| | | | |
|---|---|---|---|
| JP | 61-171359 | A | 8/1986 |

(Continued)

OTHER PUBLICATIONS

U.S. Appl. No., 11/369,156; filed Mar. 6, 2006; Inventor: Takahiro Kawaguchi; title: Armature Damper, Method of Manufacturing Armature Damper, and Dot Head.

(Continued)

*Primary Examiner*—Daniel J Colilla
(74) *Attorney, Agent, or Firm*—Fishauf, Holtz, Goodman & Chick, P.C.

(57) ABSTRACT

According to a dot head of the invention, an armature structure for moving a printing needle forward and backward has the efficiency that the magnetic characteristics is excellent and mechanical intensity is high. The armature structure is manufactured in a manner that an arm member, which is formed by subjecting a plate-shaped material excellent in abrasion resistance performance and having a high intensity to a plating processing using born etc., is sandwiched at a portion thereof from both sides in a stacked manner by two armature members each of which is formed by subjecting a plate-shaped material excellent in magnetic characteristics to a plating processing using born etc. A pin formed by subjecting a piano wire to a plating processing using boron etc. is inserted with a small pressure into common through holes of the two armature members and the arm member thus stacked thereby to provisionally assemble them. A pair of electrodes are made in contact to the portions including the slightly-pressed-in pin near the pin of the provisionally assembled two armature members and the arm member, and a current is supplied to the electrodes in a state that the portions are sandwiched by the electrodes thereby to melt and harden the plated portions using boron etc. to integrate the two armature members and the arm member.

6 Claims, 4 Drawing Sheets

U.S. PATENT DOCUMENTS

| | | | | |
|---|---|---|---|---|
| 6,682,233 | B2 | 1/2004 | Terao et al. | |
| 6,698,956 | B1 | 3/2004 | Terao et al. | |
| 6,729,782 | B2 | 5/2004 | Ichitani et al. | |
| 6,784,907 | B2 | 8/2004 | Terao et al. | |
| 6,789,964 | B2 | 9/2004 | Kawaguchi | |
| 6,848,843 | B1 | 2/2005 | Kawaguchi | |
| 6,872,016 | B2 | 3/2005 | Kawaguchi | |
| 6,994,482 | B2 | 2/2006 | Terao et al. | |
| 7,008,126 | B2 | 3/2006 | Kawaguchi | |
| 7,018,116 | B2 | 3/2006 | Tsuchiya et al. | |
| 7,048,455 | B2 | 5/2006 | Kawaguchi et al. | |
| 7,172,351 | B2 | 2/2007 | Kawaguchi | |
| 2003/0012590 | A1 | 1/2003 | Terao et al. | |
| 2003/0089223 | A1* | 5/2003 | Sugioka et al. | 92/70 |
| 2003/0096134 | A1* | 5/2003 | Sugiura et al. | 428/652 |
| 2005/0058488 | A1 | 3/2005 | Kawaguchi | |
| 2005/0160576 | A1 | 7/2005 | Kawaguchi | |
| 2005/0201797 | A1 | 9/2005 | Kawaguchi et al. | |
| 2005/0201800 | A1 | 9/2005 | Tsuchiya et al. | |
| 2005/0201801 | A1 | 9/2005 | Kawaguchi et al. | |
| 2005/0207814 | A1 | 9/2005 | Kawaguchi | |
| 2005/0207815 | A1 | 9/2005 | Terao et al. | |
| 2005/0214052 | A1 | 9/2005 | Kawaguchi et al. | |
| 2007/0065212 | A1 | 3/2007 | Kawaguchi | |
| 2007/0081843 | A1 | 4/2007 | Kawaguchi | |

FOREIGN PATENT DOCUMENTS

| | | | | |
|---|---|---|---|---|
| JP | 63288002 | A | * | 11/1988 |
| JP | 5-521 | A | | 1/1993 |
| JP | 5-318779 | A | | 12/1993 |
| JP | 6-286168 | A | | 10/1994 |
| JP | 7-256898 | A | | 10/1995 |
| JP | 7-309022 | A | | 11/1995 |
| JP | 9-314868 | A | | 12/1997 |
| JP | 2000-249166 | A | | 9/2000 |
| JP | 2004-237681 | A | | 8/2004 |
| JP | 2001-219586 | A | | 3/2005 |
| JP | 2005-75000 | A | | 3/2005 |
| JP | 2005-075000 | A | | 3/2005 |
| JP | 2005-205870 | A | | 8/2005 |

OTHER PUBLICATIONS

U.S. Appl. No. 11/369,153; filed Mar. 6, 2006; Inventor: Takahiro Kawaguchi; title: Armature Structure and Dot Head.

Japanese Office Action dated Nov. 10, 2009 and English translation thereof issued in a counterpart Japanese Application No. 2005-27658.

* cited by examiner

DOT HEAD AND METHOD OF MANUFACTURING ARMATURE STRUCTURE FOR DOT HEAD

CROSS-REFERENCE TO RELATED APPLICATION

This application is based upon and claims the benefit of priority from prior Japanese Patent Application No. 2005-276588 filed on Sep. 22, 2005, the entire contents of which are incorporated herein by reference.

BACKGROUND OF THE INVENTION

1. Field of the Invention

The present invention relates to a dot head for driving the needle of a wire dot printer and a method of manufacturing the armature structure for the dot head.

2. Description of the Related Art

The wire dot printer is arranged to move a printing wire (hereinafter, simply referred to as a wire) called a needle forward and backward to strike the tip end of the wire against a print medium thereby to print a dot-shaped image thereon. Since the wire dot printer employs such the printing method, the wire dot printer can simultaneously print plural slips etc. in a stacked state and so is employed for business use. Although there are various kinds of methods as the printing method of moving the wire (needle) forward and backward, the method called a clapper type is generally employed. The clapper type has been employed widely since the structure thereof is simple and a relatively large stroke can be secured. Such the kind of the printing method is proposed by JP-A-2005-75000, for example.

The dot head of such the clapper type includes an armature for driving a wire backward and forward. The armature is pivotally supported at a portion near the one end thereof so as to be rotatable. The armature is provided with an absorbed portion opposing to a core, at the intermediate portion between the pivotally supported portion and the free end of the armature. An arm is extended from the free end of the armature so as to be integrated with the armature. A needle for printing is provided at the tip end of the arm. The needle is attached to the arm in a manner that the axial direction of the needle crosses with the longitudinal direction of the arm at the tip end of the arm. The armature and the arm integrally provided with the armature rotate in the operation direction around the pivotally supported portion when the absorbed portion is absorbed by the magnetic force generated by the core. When the armature and the arm integrally provided with the armature rotate in the operation direction in this manner, the needle provided at the tip end of the arm move forward. In contrast, when the magnetic force having been generated by the core disappears, the armature and the arm integrally provided with the armature rotate in the restoring direction by a spring force etc. and so the needle move backward.

The dot head is arranged in a manner that a plurality of the armatures each thus configured are disposed radially around a print portion.

As described above, the armature integrally provided with the arm moves the needle forward and backward at a high speed for many times in response to the magnetic field. In order to attain such the function, the armature is required to be formed by material with a high magnetic permeability and excellent durability. Conventionally, pure iron is widely used as the material of the armature. Since the pure iron is relatively soft, the pure iron is subjected to the carburization processing thereby to increase the strength thereof. However, it is very troublesome to subject the pure iron to the carburization processing, and the pure iron having been subjected to the carburization processing leaves much to be improved in efficiency such as a magnetic permeability and durability.

SUMMARY OF THE INVENTION

An object of the invention is to provide a dot head which realizes high speed printing and excellent durability and also to provide a method of manufacturing an armature structure which is used for the dot head and has a high magnetic permeability and excellent durability.

According to an embodiment of the invention, a dot head including:

an armature structure which includes two armature members, an arm member and a printing needle provided at a tip end of the arm member in a longitudinal direction thereof, each of the two armature members being formed by subjecting a plate-shaped material excellent in magnetic characteristics to a plating processing using born etc., the arm member being formed by subjecting a plate-shaped material excellent in abrasion resistance performance and having a high intensity to a plating processing using born etc., a part of the arm member on a base end side in the longitudinal direction thereof being sandwiched by the two armature members, and the plated portions of the two armature members and the arm member to be joined to each other being melted and hardened by a spot welding;

a fulcrum shaft which pivotally supports the base end of the armature structure in the longitudinal direction thereof so as to be rotatable; and a core which opposes to an intermediate portion of the armature structure in the longitudinal direction thereof and is able to apply magnetic force to the intermediate portion arbitrarily, wherein the armature structure rotates around the fulcrum shaft in accordance with presence or non-presence of the magnetic force to move the needle provided at the tip end forward or backward.

Further, according to an embodiment of the invention, a method of manufacturing an armature structure for a dot head, including the steps of:

stacking an arm member, which is formed by subjecting a plate-shaped material excellent in abrasion resistance performance and having a high intensity to a plating processing using born etc., and two armature members, each of which is formed by subjecting a plate-shaped material excellent in magnetic characteristics to a plating processing using born etc., in a state that the a part of the arm member is sandwiched from both sides thereof by the two armature members;

inserting with a small pressure a pin formed by subjecting a piano wire to a plating processing using boron etc. into common through holes of the two armature members and the arm member thus stacked thereby to provisionally assemble the two armature members and the arm member; and contacting a pair of electrodes to portions including the slightly-pressed-in pin near the pin of the provisionally assembled two armature members and the arm member in a state that the portions are sandwiched by the electrodes, to supply a current to the electrodes thereby to melt and harden the plated portions using boron etc.

DETAILED DESCRIPTION OF THE INVENTION

An embodiment of the invention will be explained in detail with reference to the accompanying drawings.

Figure 1:
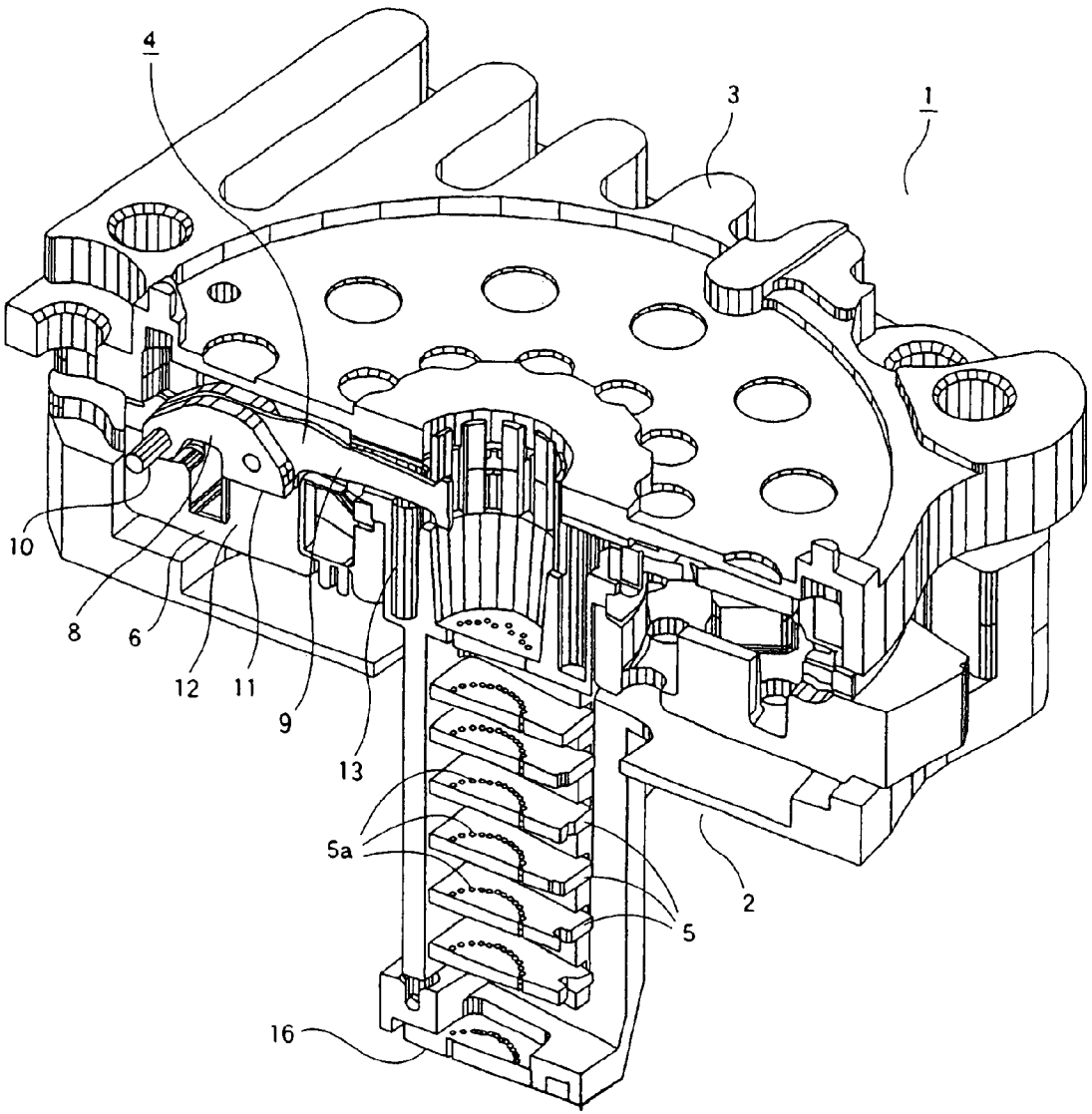
FIG. 1 is a perspective sectional view for explaining a dot head according to the first embodiment of the invention, in which the dot head is cut longitudinally along the center portion thereof.

First, the explanation will be made with reference to FIG. 1 as to the entire configuration of the dot head of a wire dot printer. FIG. 1 is a perspective sectional view schematically showing the dot head 1, in which the dot head is cut longitudinally along the center portion thereof.

The dot head 1 includes a front casing 2 and a rear casing 3 which are coupled by attachment screws (not shown) Armature structures 4, wire (needle) guides 5 and yokes 6 etc. are provided between the front casing and the rear casing.

The armature structure 4 includes, although the detailed structure thereof is described later, an armature 8 and an arm 9 extended from the free end (the right end in the figure) of the armature 8. The armature 8 is provided with a fulcrum shaft 10 near the one end (the left end in the figure) thereof so as to be rotatable therearound in a manner that the tip end of the armature moves in an arc manner. An absorbed portion 11 is formed at the side portion (the lower surface in the figure) between the fulcrum shaft 10 and the free end (the right end in the figure) of the armature 8. The absorbed portion 11 opposes to a core 12 which is integrally provided with the yoke 6. That is, the yoke 6 is formed in an annular shape (doughnut shape) along the inner peripheries of the casings 2 and 3. The core 12 is integrally formed on the upper surface of the yoke 6 so as to oppose to the absorbed portion 11 of corresponding one of the armatures 8.

A plurality of the armature structures 4 are disposed radially with respect to the axle center of the annular-shaped yoke 6. The armature structure 4 is supported on the upper surface of the yoke 6 in a state that the free end side thereof rotates freely around the fulcrum shaft 10 in the direction away from the yoke 6. Further, the armature structure is biased in the direction (the upper direction in the figure) away from the yoke 6 by a not-shown spring within a cylindrical member 13 disposed vertically at the lower portion near the tip end of the arm 9.

A not-shown coil is wound around the core 12. When a current is supplied to the coil, magnetic field is generated to attract the absorbed portion 11 of the armature 8. Thus, the armature 8 and the arm 9 integrally provided with the armature rotate clockwise in the figure around the fulcrum shaft 10.

A not-shown printing wire (needle) is attached by the hard soldering to the tip end of the arm 9 in the longitudinal direction thereof. The wire is attached downward in the figure so that the axial direction thereof crosses with the longitudinal direction of the arm 9.

Thus, when the armature 8 and the arm 9 integrally provided with the armature rotate clockwise in the figure around the fulcrum shaft 10 by the magnetic force generated by the core 12, the not-shown wire provided at the tip end of the arm 9 moves forward in the downward direction in the figure until the tip end of the wire collides with a print medium such as a print sheet. When the magnetic force having been generated by the core 12 disappears, the arm moves backward in the upward direction in the figure by the repulsive force of the not-shown spring within the cylindrical member 13.

The wire guide 5 includes guide holes Sa through which not-shown wires pass so as to guide the wires forward and backward freely so that the tip end of each of the wires collides with a predetermined position of a print medium. The front casing 2 is provided with a tip end guide 16 which lines up the tip ends of the wires in a predetermined pattern and guides the wires forward and backward freely.

Figure 2:
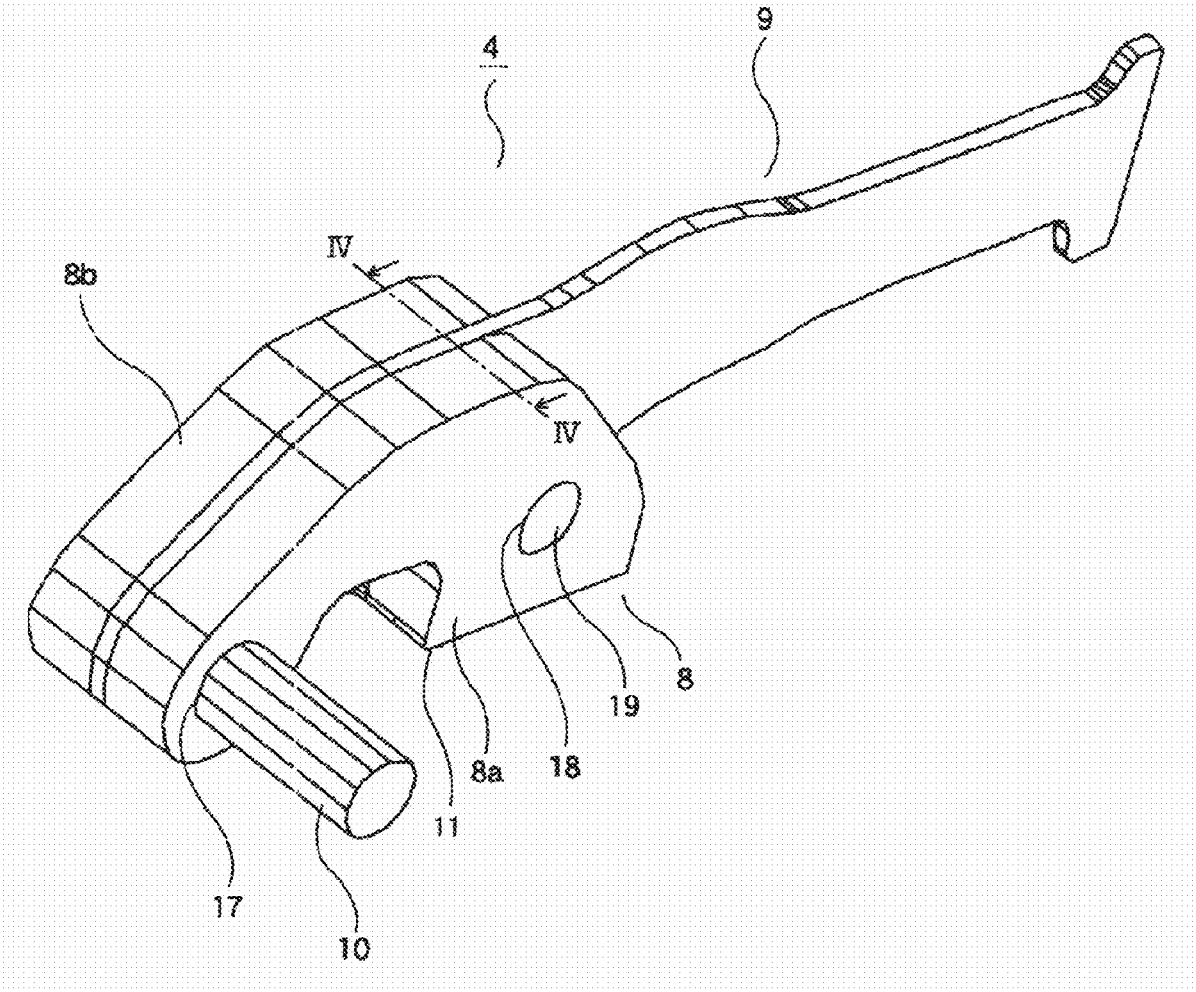
FIG. 2 is a perspective view showing an armature structure used in the dot head according to the first embodiment of the invention.

Next, the armature structure 4 will be explained with reference to FIG. 2. As described above, the armature structure 4 is formed by integrating the armature 8 and the arm 9. The armature 8 includes two armature members 8*a* and 8*b*. Each of the armature members 8*a* and 8*b* is formed by a sheet-shaped material excellent in magnetic characteristics such as iron-cobalt alloy (49Co-2V-49Fe) and the surface thereof is plated by using boron etc. The arm 9 employs, as an arm member, a sheet-shaped SK-5M material (Hv580) subjected to the heat processing, for example, in order to secure abrasion resistance and intensity. The arm member (hereinafter, referred to by a reference numeral 9 same as that of the arm) is also plated by using boron etc.

The arm member 9 is sandwiched in a stacked manner at the portion on the base end side thereof between the two armature members 8*a* and 8*b*. Each of the two armature members 8*a* and 8*b* and the arm member 9 is provided with a common through hole 17 at the portion near the left end thereof in the figure so that the fulcrum shaft 10 penetrates these common holes in the stacked state of the two armature members and the arm member. A through hole 18 common to the two armature members 8*a* and 8*b* and the arm member 9 thus stacked is provided for the provisional assembling at a portion near the right end of the armature 8 in the figure. A pin 19 is pressed with a small pressure into the through holes 18 for the provisional assembling thereby to provisionally assembling the armatures and the arm member. A high-intensity piano wire which surface is subjected to the plating processing using boron etc. is used as the pin 19.

Each of the armature members 8*a* and 8*b* is subjected to the nitriding processing so as to have the specification of a thickness of 8 μm and the surface hardness of Hv 800 or more in order to secure the abrasion resistance performance. The armature structure 4 is provisionally assembled by inserting the pin 19 within the through holes 18 as described above. In this case, when the pin 19 is inserted with the press-into relation(that is, the interference fit or close fit relation) into the through holes 18 of the armature members 8*a* and 8*b* each of which is formed by subjecting the nitriding processing to the iron-cobalt alloy that is brittle material as described above, there may arise a case that the armature members 8*a* and 8*b* are broken. Thus, the through holes 18 of the armature members 8*a* and 8*b* and the pin 19 maintain the slight press-into relation.

The plating processing using boron etc. is a plating processing using electroless Ni—P—B or electroless Ni—B. The plating processing using boron etc. is performed on the surface of each of the armature members 8*a* and 8*b* and the arm member 9 with a thickness of 5±1 μm.

The armature structure 4, thus provisionally assembled by sandwiching the part of the arm member 9 between the armature members 8*a* and 8*b* from the both sides thereof in a stacked manner and by inserting the pin 19 into the through holes 18 with a small pressure, is subjected to the spot welding thereby to integrate these armature members and the arm member. That is, a pair of electrodes are made in contact from the opposite outer sides of the armature members 8*a* and 8*b* to the portions including the slightly-pressed-in pin 19 near the pin 19 of the provisionally assembled armature structure 4, and a current is supplied to the electrodes in a state that the portions are sandwiched by the- electrodes with a pressure thereby to melt and harden the plated portion using boron etc.

Figure 3:
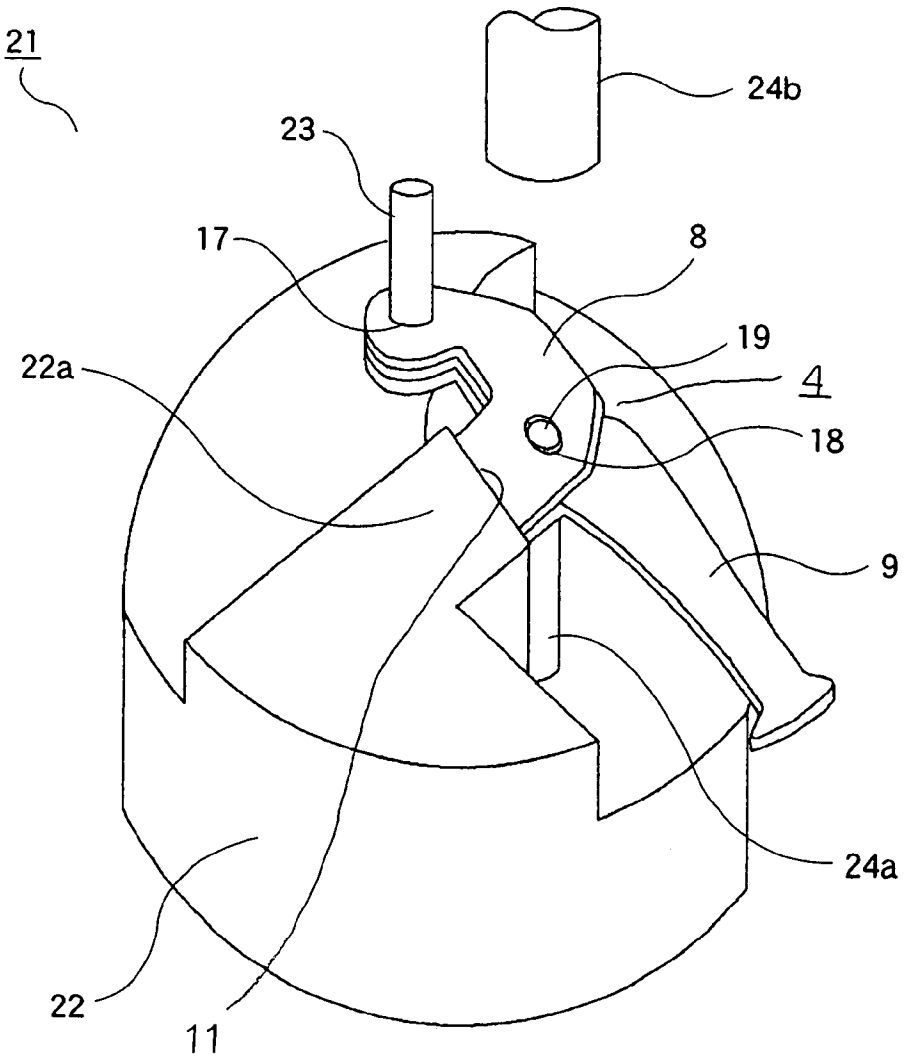
FIG. 3 is a perspective view for explaining a spot welding state in an armature structure manufacturing method according to the first embodiment of the invention.

In the case of performing the spot welding, a jig 21 for welding is used as shown in FIG. 3. The jig 21 is configured in a manner that a pin 23 made from ceramics and having an outer diameter same as that of the fulcrum shaft 10 is formed on a table 22 made from insulating material so as to be erected therefrom. The mechanism 4 thus provisionally assembled is attached in a manner that the through holes 17 for the fulcrum shaft 10 are fit with the pin 23. A portion 22*a* corresponding to the core 12 shown in FIG. 1 is formed on the table 22 of the jig 21. The portion 22*a* abuts against the absorbed surface 11 of the sidewise armature structure 4 having the pin 23 fit into the through holes 17 thereby to position the armature structure 4 at the welding position shown in the figure.

One 24*a* of the electrodes for the spot welding is provided in an erected manner near the portion 22*a* so as to be in parallel to the pin 23. The upper end surface of the electrode 24*a* is made in contact from the lower side surface of the armature structure 4 in the figure to the portions including the slightly-pressed-in pin 19 near the pin 19 of the armature structure 4 positioned by the pin 23 and the portion 22*a*.

The other electrode 24*b* is disposed above the one electrode 24*a* for the spot welding in an opposed manner with a space therebetween. At the time of the welding, the other electrode 24*b* is lowered to make the lower end surface thereof contact with the portion including the slightly-pressed-in pin 19 near the pin 19 from the upper surface side of the armature structure in the figure. Then, the pair of electrodes 24*a* and 24*b* are pressed against the portions including the slightly-pressed-in pin 19 near the pin 19 of the armature structure 4 with a predetermined pressure so as to sandwich the portions therebetween by the electrodes and a current is supplied to the electrodes.

Each of the pair of electrodes 24*a* and 24*b* for the spot welding is made from chromium-copper. A portion of each of the electrodes contacting with the surface of the armature structure 4 is planer and has a diameter of 4.2 mm.

Figure 4:
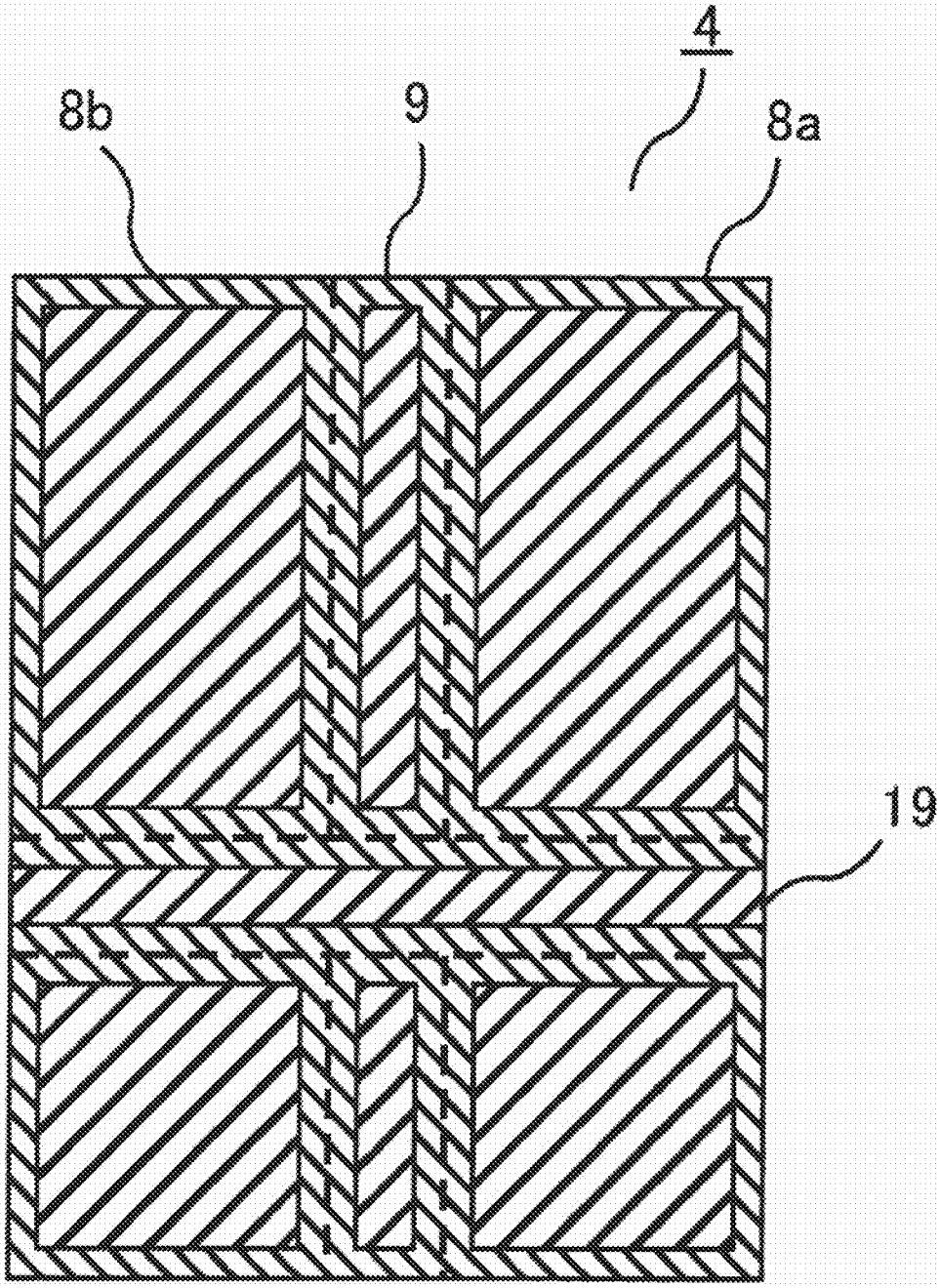
FIG. 4 is a cross-sectional view taken along line IV-IV of FIG. 2, viewed in a direction indicated by the arrows.

According to this spot welding, as shown in FIG. 4, the plating using boron etc. melts and then becomes solid at the regions between the armature members 8*a*, 8*b* and the arm member 9 of the armature structure 4 and also at the regions between the armature members 8*a*, 8*b*, the arm member 9 and the pin 19, whereby the armature structure 4 is integrated stiffly. The joining force of 8 kg cm or more is secured by the spot welding. Further, according to the spot welding, a loss of the plating or a partial deformation of the armature structure does not occur. The joining force of 8 kg cm or more is a value that sufficiently guarantees the durability (three hundred million dots or more in the case of 2,500 times/sec) required of the armature structure 4.

The weld nugget area caused by the spot welding is formed on the surfaces of the joined portions between the armature members 8*a*, 8*b* and the arm member 9 around the portions including the pin 19 near the pin 19 at which the welding electrodes 24*a*, 24*b* contact, whereby the firm joining force as described above can be attained. Although there arises a case that the plating is partially melted and protrudes outside of the armature structure 4, the protruded portion does not interfere with other parts. Since such the weld nugget is formed at the plated portion on the surface of the armature 8 constituting a magnetic circuit, there does not occur such a phenomenon that the magnetic characteristics of the armature members 8*a*, 8*b* changes due to the heat of the spot welding, so that the good magnetic characteristics can be maintained.

As described above, the plating processing using boron etc. is the plating processing using electroless Ni—P—B or electroless Ni—B. Since each of these plating processings employs boron, the resulted plating is stiff and good in the welding property. Further, the plating is not burnt by the welding. Thus, there does not occur such a phenomenon that voids are generated by the burning, so that the stable melted and hardened state of the plating can be obtained. Conventionally, the plating processing using electroless Ni—P has been employed as such a kind of the metal plating processing since electroless Ni—P is cheap. However, since the electroless Ni—P contains phosphorus, the plating material may burn at the time of the welding. When the plating material burns, voids are generated and so the plated material is placed in a melted and hardened state containing many voids. In contrast, in the case of the plating processing using electroless Ni—P—B or electroless Ni—B, since each of the plating using electroless Ni—P—B and the plating using electroless Ni—B contains boron, the plating material does not burn at the time of the welding, so that the stable melted and hardened state can be obtained.

However, since the plating processing using electroless Ni—P—B or electroless Ni—B is expensive, the plating processing using cheap electroless Ni—P may be performed on a lower layer in order to suppress the cost. That is, the plating processing may be performed in a manner that the plating processing using the cheap electroless Ni—P is performed on a lower layer so as to have a thickness of 2.5 μm in the case where the entire plating thickness is expected to be 5 μm, and the plating processing using the expensive electroless Ni—P—B or electroless Ni—B is performed thereon so as to have a thickness of 2.5 μm thereby to obtain the plating thickness of 5 μm in total.

In this manner, even in the case where the plating using the electroless Ni—P is formed as a lower layer so as to have a thickness of 2.5 μm, when the plating using the electroless Ni—P—B or electroless Ni—B is formed thereon so as to have a thickness of 2.5 μm, the plating material does not burn at the time of the welding. This technical effects was confirmed by the experimentation performed by the inventors of the present application.

Accordingly, the stable melted and hardened state can be realized at a low cost without generating any void due to the burning.

As described above, since the armature members each excellent in the magnetic characteristics and the arm member having a high intensity and excellent abrasion resistance property are integrally formed, the armature structure having a high magnetic permeability and excellent durability can be provided. Further, since the integration is performed in a manner that the plating using boron etc. formed on the surfaces of the armature members and the arm member is melted by the spot welding thereby to join the armature members and the arm member, the magnetic characteristics of the material is not influenced at all. Furthermore, since the plating processing using boron etc. is performed, there does not occur such a phenomenon that the plating is burnt by the spot welding and so voids are generated by the burning, so that the stable and high-intensity melted and hardened state of the plating can be obtained.

What is claimed is:

1. A dot head comprising:

an armature structure which includes two armature members formed by subjecting a magnetic plate-shaped material to boron-based plating, and an arm member formed by subjecting a plate-shaped material made of steel to boron-based plating, wherein one end side of a printing needle is provided at a tip end of the arm member in a longitudinal direction of the arm member, wherein one side surface of each of the armature members is joined to a corresponding side surface of the arm member at a base end side of the arm member in the longitudinal direction, such that the two armature members are joined to both sides, respectively, of the arm member, and wherein plated portions of the joined parts of the two armature members and the arm member are melted together and hardened so that the plating on the armature members and arm member form an integrated and one-piece structure;

a fulcrum shaft which pivotally supports a base end of the armature structure in a longitudinal direction thereof so as to be rotatable; and a core which opposes an intermediate portion of the armature structure in the longitudinal direction thereof and which is able to apply magnetic force to the intermediate portion arbitrarily.

2. A dot head according to claim 1, wherein the magnetic plate-shaped material used for each of the armature members is an iron-cobalt alloy.

3. A dot head according to claim 1, wherein the boron-based plating comprises a plating processing using electroless Ni—P—B.

4. A dot head according to claim 1, wherein the boron-based plating comprises a plating processing using electroless Ni—B.

5. A dot head according to claim 1, wherein the boron-based plating as applied to at least one of the armature members and the arm member includes a plating processing using electroless Ni—P performed on a lower layer and a plating processing using electroless Ni—P—B performed thereon.

6. A dot head according to claim 1, wherein the boron-based plating as applied to at least one of the armature members and the arm member includes a plating processing using electroless Ni—P performed on a lower layer and a plating processing using electroless Ni—B performed thereon.

* * * * *